US009217212B2

(12) United States Patent
Warner et al.

(10) Patent No.: US 9,217,212 B2
(45) Date of Patent: Dec. 22, 2015

(54) OVEN WITH GAS CIRCULATION SYSTEM AND METHOD

(75) Inventors: Patrick Alan Warner, Rosemount, MN (US); Michael James Franklin, Apple Valley, MN (US)

(73) Assignee: Despatch Industries Limited Partnership, Lakeville, MN (US)

( * ) Notice: Subject to any disclaimer, the term of this patent is extended or adjusted under 35 U.S.C. 154(b) by 862 days.

(21) Appl. No.: 13/354,112

(22) Filed: Jan. 19, 2012

(65) Prior Publication Data

US 2012/0189968 A1 Jul. 26, 2012

Related U.S. Application Data

(60) Provisional application No. 61/435,095, filed on Jan. 21, 2011, provisional application No. 61/468,464, filed on Mar. 28, 2011.

(51) Int. Cl.

| | |
|---|---|
| ***F24F 9/00*** | (2006.01) |
| ***F27D 7/06*** | (2006.01) |
| ***D01F 9/32*** | (2006.01) |

(52) U.S. Cl.

CPC ..... *D01F 9/32* (2013.01)

(58) Field of Classification Search

CPC ..... F27B 9/28; F27B 9/10; C21D 9/56; C21D 9/5732; F26D 13/10

USPC ..... 432/8, 59, 64, 242, 246; 148/568; 34/444, 459, 611, 618, 640, 643

See application file for complete search history.

(56) References Cited

U.S. PATENT DOCUMENTS

| | | | | |
|---|---|---|---|---|
| 4,515,561 | A | | 5/1985 | Melgaard |
| 4,545,762 | A | | 10/1985 | Arita et al. |
| 4,551,091 | A | | 11/1985 | Paterson |
| 4,559,010 | A | | 12/1985 | Katsuki |
| 4,610,860 | A | * | 9/1986 | Mullen ..... 423/447.8 |
| 4,678,433 | A | * | 7/1987 | Ellison ..... 432/59 |
| 4,847,009 | A | | 7/1989 | Madle et al. |
| 5,230,460 | A | * | 7/1993 | Deamborsio et al. ..... 228/180.1 |

(Continued)

FOREIGN PATENT DOCUMENTS

| | | | |
|---|---|---|---|
| EP | 0426858 | A1 | 5/1991 |
| WO | 2011098215 | A1 | 8/2011 |
| WO | 2011098223 | A1 | 8/2011 |

OTHER PUBLICATIONS

Notification of Transmittal of the International Search Report and the Written Opinion of the International Searching Authority, or the Declaration for co-pending application PCT/US2012/022031 mailed Apr. 18, 2012, 8 pages.

*Primary Examiner* — Gregory A Wilson

(74) *Attorney, Agent, or Firm* — Fogg & Powers LLC

(57) ABSTRACT

An oxidation oven with a heated chamber for treating fibers, the heated chamber having two opposing sides, each side with a plurality of gaps to allow the fibers to pass to and from the heated chamber. Embodiments of the invention provide capture ducts, which are configured to be under negative pressure, the capture ducts draw-in heated chamber air that would otherwise flow through the gaps. Embodiments of the invention provide supply ducts, which are configured to be under positive pressure and provide heated air near the gaps. Embodiments of the invention provide louvers positioned near the gaps, the louvers are configured to reduce the flow of heated chamber air that would otherwise pass through the gaps.

20 Claims, 7 Drawing Sheets

(56) References Cited

U.S. PATENT DOCUMENTS 5,908,290 A 6/1999 Kawamura et al.
6,027,337 A * 2/2000 Rogers et al. ..... 432/64
6,282,811 B1 * 9/2001 Voth ..... 34/417
6,776,611 B1 * 8/2004 Sprague ..... 432/64
7,004,753 B2 * 2/2006 Stockhausen ..... 432/59
7,335,018 B2 * 2/2008 Yamaguchi ..... 432/59

* cited by examiner

OVEN WITH GAS CIRCULATION SYSTEM AND METHOD

RELATED APPLICATIONS

This application claims priority to U.S. Provisional Patent Application Ser. No. 61/435,095, filed Jan. 21, 2011, and titled "Oven with Gas Circulation System & Method" and to U.S. Provisional Patent Application Ser. No. 61/468,464, filed Mar. 28, 2011, and titled "Oven with Gas Circulation System and Method," the contents of which are hereby incorporated by reference.

TECHNICAL FIELD

The present disclosure pertains to regulating gas circulation into, out of, and within an oxidation oven.

BACKGROUND

Carbon fibers are typically produced from a precursor that can be made from different materials, such as an acrylic, pitch, or cellulose fibers. According to a common processing method, in an initial step, fibrous segments of the precursor material are successively drawn through an oxidation oven, which heats the segments, by means of a circulating flow of hot gas, to a temperature approaching approximately 300° C. An example of such an oven is the Despatch Carbon Fiber Oxidation Oven, available from Despatch Industries, Minneapolis, Minn. A description of such an oven may be found in commonly-assigned U.S. Pat. No. 4,515,561, which is hereby incorporated by reference in its entirety.

In the oxidation oven, the precursor fibers pass back and forth through the oven chamber via a series of rollers. FIG. 1 provides a schematic view of a simple oxidation oven. As can be seen, the fibers move through the oven by passing through the vestibule, through the transition area, through the oven chamber, through the other transition area, and through the other vestibule. At that point, the fibers pass around the roller and back through the oven in the reverse direction. By passing the fibers back and forth all the way through the oven (and perhaps additional ovens), the fibers can be further processed into oxidized fiber.

One noteworthy aspect of such an oxidation oven is that the rollers are positioned outside the oven. The interior of the oven is too hot for conventional rollers, and custom-designing rollers to withstand the heat is generally not practicable. Additionally, there are process benefits to passing the fibers through atmospheric conditions with each pass through the oven. There must be gaps in the sides of the oven to allow the fibers to pass between the rollers and the interior of the oven.

However, the ability to pass the fibers freely between the rollers and the interior of the oven must be balanced with the desire to isolate the oven chamber from the atmosphere surrounding the oven, including inhibiting relatively cold atmospheric air from seeping into the chamber through the gaps, as such air can adversely affect how the fibers are processed.

In the oxidation oven shown in FIG. 1, the vestibules and the transition areas aim to isolate the oven chamber from the surrounding atmosphere. Conventional transition areas include return ducts. Return ducts direct chamber gas that is near the transition area back to the chamber's heater for recirculation into the chamber. A byproduct of the reaction that occurs inside the chamber is HCN gas. Any gas that flows past the transition area enters the vestibule. Vestibules are under negative pressure. Exhaust from the vestibule flows into abatement equipment to remove the HCN before venting to the atmosphere.

While such vestibules and transition areas are satisfactory, they have limitations. First, processing the vestibule's entire volume of gas through the abatement equipment is not efficient. Moreover, the vestibules and the transition areas do not meaningfully address the problem of cooler atmospheric air entering the oven chamber through the gaps.

SUMMARY

Embodiments of the present invention provide equipment that can be incorporated into an oxidation oven for effectively isolating the oxidation oven from the surrounding atmosphere while significantly reducing the volume of gas that is provided to the abatement equipment.

Embodiments of the present invention include capture ducts positioned near the transition between the oven chamber and the vestibule that inhibit gas from exiting the chamber to enter the vestibule. Such capture ducts are under negative pressure, thereby allowing them to draw in chamber gas before that gas escapes into the vestibule. In preferred embodiments, the capture ducts are positioned near the top one or several gaps and/or return ducts.

Embodiments of the present invention include supply ducts positioned near the transition between the oven chamber and the vestibule that regulate the flow of relatively cold air into the oven chamber. Such supply ducts can supply warm gas toward one or both sides of the precursor fibers being processed. In this way, the supply ducts can create a "cushion of air" that (a) inhibits atmospheric air from entering the oven chamber and (b) warms any such air that flows past the cushion of air into the chamber, thereby significantly reducing the adverse effects on the process. In preferred embodiments, the supply ducts are positioned near the bottom one or several gaps and/or return ducts.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

Figure 1:
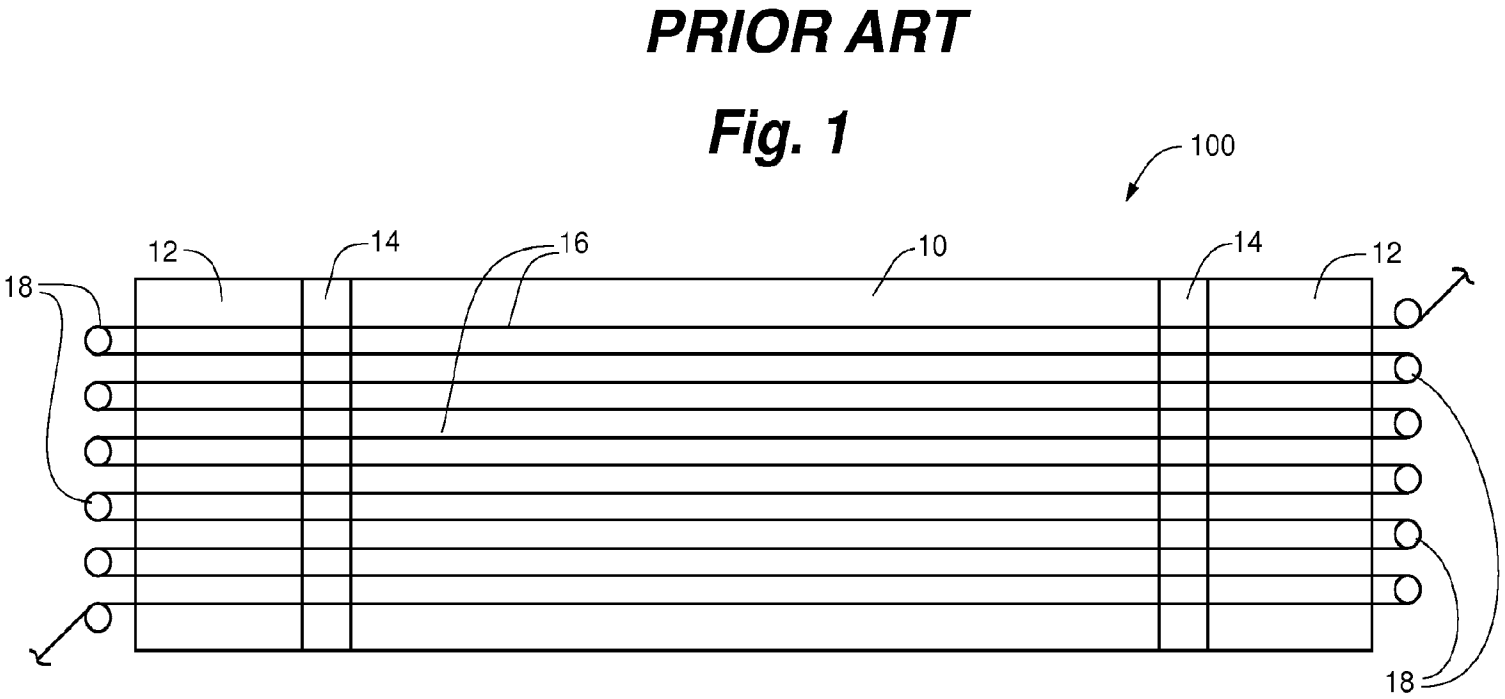
PRIOR ART Fig. 1
FIG. 1 is a schematic side view of a conventional oxidation oven.

As noted above, FIG. 1 shows a conventional oxidation oven 100. In the oxidation oven 100, the precursor fibers 16 pass back and forth through the oven chamber via a series of rollers 18. The oxidation oven 100 includes an oven chamber 10 with vestibules 12 on both ends. Between the vestibules 12 and the oven chamber 10 are transition areas 14. The vestibules 12 serve as buffers between the atmosphere and the rest of the oven, and the transition areas 14 serve as buffers between the vestibules 12 and the chamber 10. As noted above, U.S. Pat. No. 4,515,561 provides additional detail on some oxidation ovens.

An objective of many such oxidation ovens 100 is to keep as much of the chamber gas as possible in the chamber 10. It has been determined that warm gas near the upper gaps of the oven chamber 10 has a greater tendency to flow from the chamber 10 toward the vestibule 12. Moreover, it has been determined that gas near the lower gaps of the oven chamber 10 is significantly less likely to flow from the oven chamber 10 toward the vestibule 12. On the contrary, it has been determined that gas is more likely to be drawn through the lower gaps of the oven 100 from the vestibule 12 into the chamber 10. In most instances, such gas is at a significantly lower temperature than the temperature within the chamber 10. This can lead to low temperature zones within the chamber 10 in the areas near the lower gaps, which adversely affects the processing of the fibers.

In many instances, there is a correlation between the chamber gas near the upper gaps tending to flow out of the chamber and gas being drawn into the chamber through the lower gaps from the vestibule 12. As chamber gas flows out of the chamber 10 through the upper gaps, chamber gas near the lower gaps tends to rise, filling the space vacated by the outflowing gas. This creates space near the lower gaps, which leads to drawing gas from the vestibules 12 in order to fill this space. This can be referred to as a chimney effect, which leads to an increased volume of heated chamber air flowing into the vestibule 12 and decreased temperatures within the chamber 10 near the lower gaps.

Figure 2:
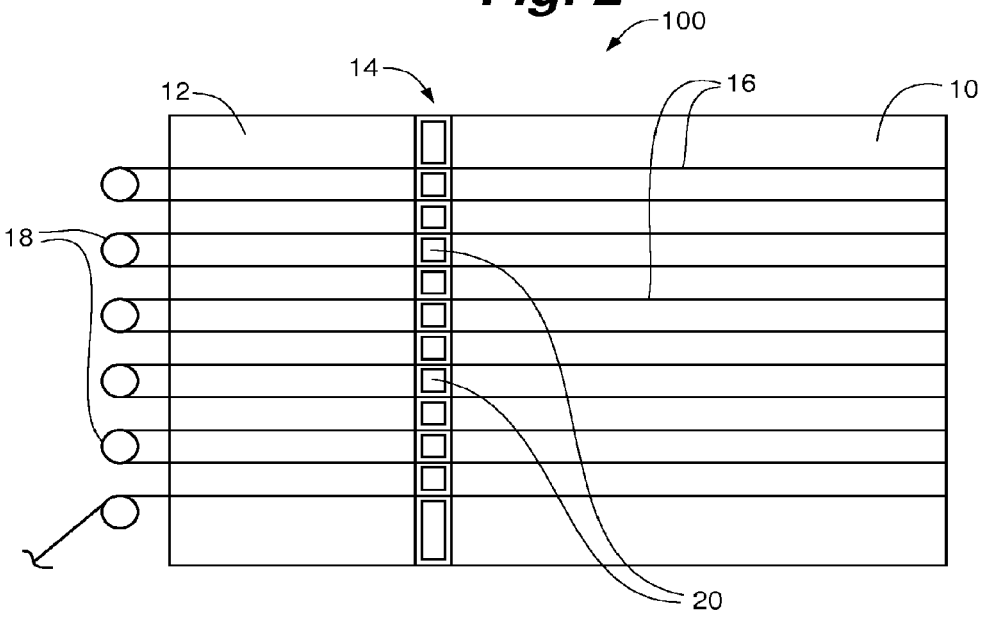
PRIOR ART Fig. 2
FIG. 2 is a closer schematic side view of one end of the oxidation oven of FIG. 1.
Figure 3:
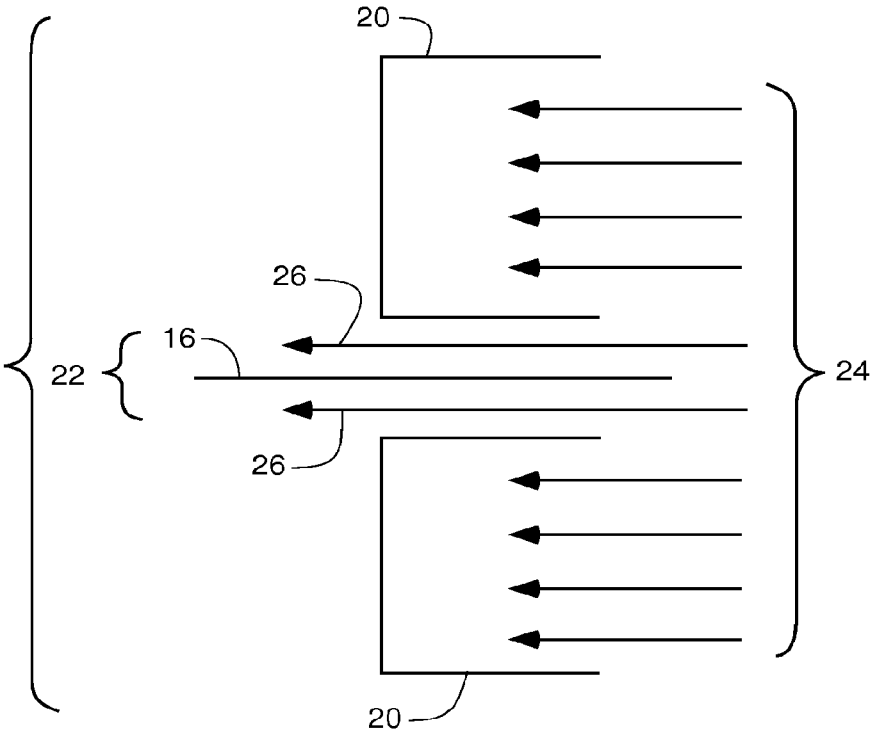
PRIOR ART Fig. 3
FIG. 3 a schematic side view of a portion of the conventional oxidation oven of FIG. 1.

FIG. 2 shows the transition area 14 of a conventional oxidation oven 100 in greater detail. As can be seen, the transition area 14 includes a series of return ducts 20 positioned between each gap through which the precursor fibers 16 pass. The return ducts 20 are typically positioned within the oven chamber 10 (on the chamber side of a wall that separates the chamber 10 and the vestibule 12) and are usually at roughly the same pressure as within the chamber 10. FIG. 3 provides a closer view of two return ducts 20 positioned above and below a gap 22. As can be seen, much of the chamber gas 24 flowing toward the vestibule encounters the return ducts 20, which prevents such gas 24 from flowing freely into the vestibule and instead redirects this gas 24 back into the chamber 10. The return ducts 20 can be typically configured to channel such gas 24 in a direction into or out of the page, and in many cases to heating equipment, to be reintroduced into the chamber 10.

As can be seen in FIG. 3, however, in conventional ovens, it is assumed that some gas 26 will escape the chamber into the vestibule 12. Two arrows 26 nearest the precursor fiber 16 represent chamber gas flowing past the return ducts 20 into the vestibule 12 (which, as noted above, is most likely to occur in the upper gaps). In many instances involving such conventional ovens 100, a large volume of heated chamber air enters the vestibule. The gas within the vestibule 12 must be routed through abatement equipment. Regularly circulating such a large volume of gas to abatement equipment is not efficient. In addition, as the volume of heated chamber air that flows through the upper gaps and into the vestibule 12 increases, the more gas that is drawn into the chamber through the lower gaps via the above-referenced chimney effect.

Figure 4:
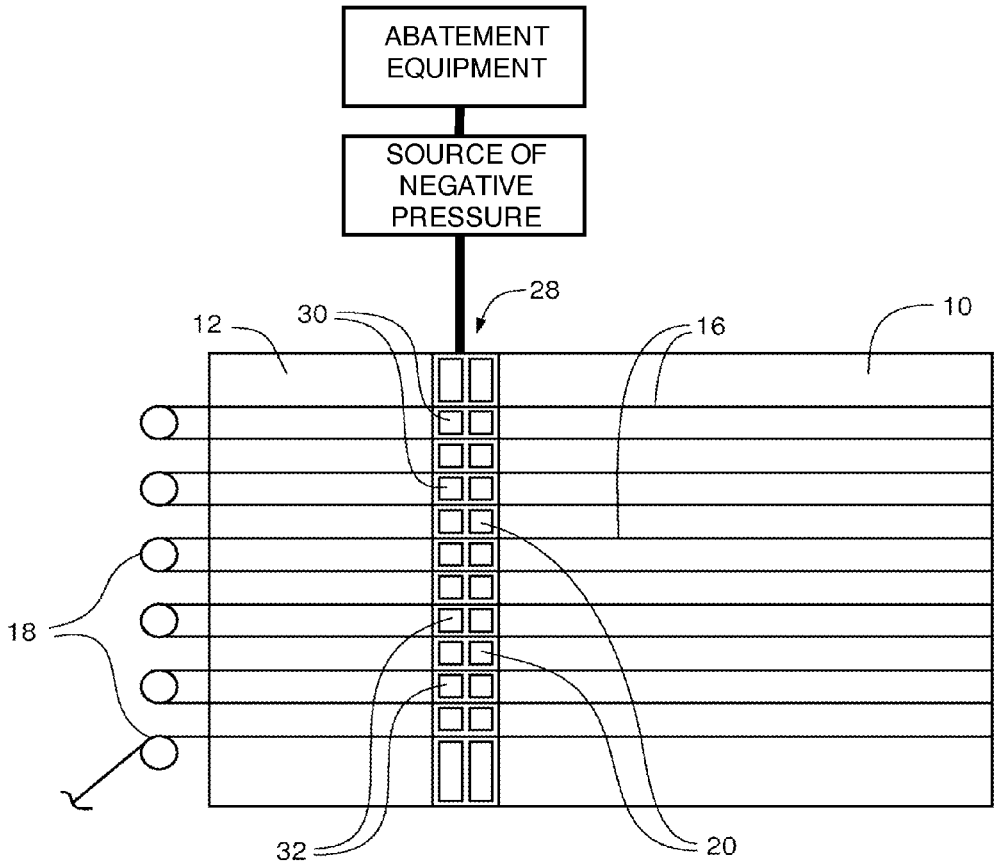
FIG. 4 is a schematic side view of one end of an oxidation oven in accordance with embodiments of the present invention.

FIG. 4 shows a transition area 28 with return ducts 20 like those of FIG. 2 but also with additional equipment in accordance with embodiments of the present invention. As can be seen, capture ducts 30 and supply ducts 32 can be provided between the return ducts 20 and the vestibule 12. As shown, the capture ducts 30 are provided on roughly the upper half of the gaps (the top six, as shown in FIG. 4), and the supply ducts 32 are provided for roughly the lower half of the gaps (the bottom six, as shown in FIG. 4). As discussed in greater detail below, the capture ducts 30 can be at negative pressure such that any gas that flows through the gaps past the return ducts 20 can be sucked into the capture ducts 30 and provided to the abatement equipment. As also discussed in greater detail below, the supply ducts 32 can be at a positive pressure with air flowing out of them in order to inhibit vestibule gas from being drawn into the chamber 10.

Figure 5:
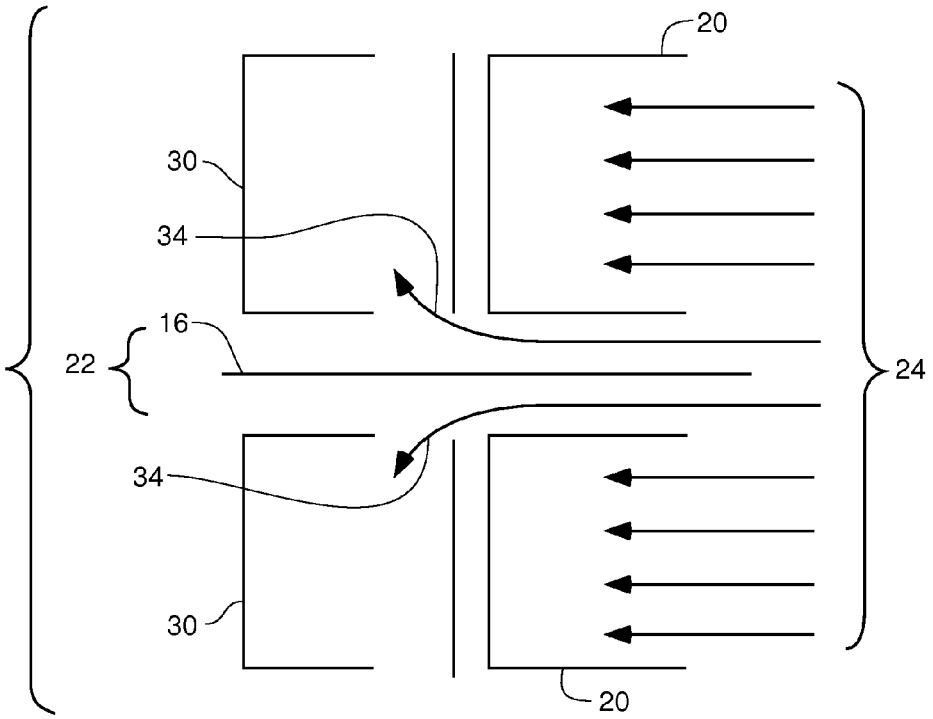
FIG. 5 is a schematic side view of a portion of an oxidation oven in accordance with embodiments of the present invention.

FIG. 5 shows a closer view of two capture ducts 30 in operation on either side of a gap 22 through which precursor fiber 16 passes. As in FIG. 3, much of the chamber gas 24 that flows from the chamber 10 toward the vestibule 12 encounters the return ducts 20. As noted above, the return ducts 20 are configured to recirculate the gas 24 that encounters them back into the chamber 10. Unlike in FIG. 3, however, gas 34 that flows through the gap 22 past the return ducts 20 is unable to flow freely into the vestibule 12 but is captured by the capture ducts 30. The capture ducts 30 can be at a pressure of approximately −0.20" to −1.00" w.c. (water column) (approximately −50 Pa to −250 Pa) relative to the outside atmospheric pressure. This allows the capture ducts 30 to suck in chamber gas 34 that flows past the return ducts 20 and provide such gas 34 to the abatement equipment. The volume of gas that is able to make it past both the return duct 20 and the capture duct 30 is significantly reduced. Such small quantity of chamber gas can mix with the atmospheric air in the vestibule 12 and can be vented to the atmosphere rather than to the abatement equipment.

Figure 6:
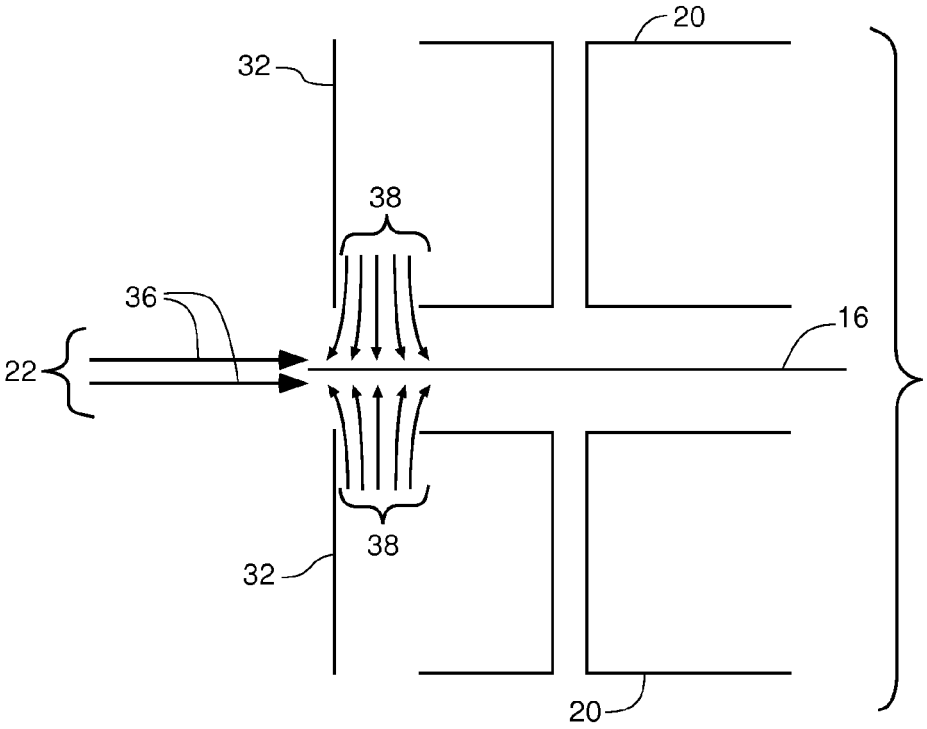
FIG. 6 is a schematic side view of a portion of an oxidation oven in accordance with embodiments of the present invention.

FIG. 6 shows a closer view of two supply ducts 32 in operation on either side of a gap 22 through which precursor fiber 16 passes. As discussed above, a chimney effect can tend to draw atmospheric air 36 into the chamber 10 through the lower gaps. The atmospheric air 36 is at a substantially lower temperature than that of the chamber 10. Thus, it is undesirable for such atmospheric air 36 to enter the chamber 10. As can be seen, the supply ducts 32 direct a flow of air 38 toward the precursor fiber 16. This flow of air 38 can be somewhat similar to an air curtain that impedes atmospheric air 36 from entering the chamber 10. Due to the flow of air 38 from the supply ducts 32, the environment just outside of the supply duct output can be likened to a "cushion of air." Atmospheric air 36 that encounters the outflow of air 38 near the supply ducts 32 can have difficulty in passing across the transition area 14. In this way, air 38 provided via the supply ducts 32 can significantly reduce the volume of atmospheric air 36 that is drawn into the chamber 10. Moreover, in many embodiments, the air 38 that is supplied by the supply ducts 32 can be at an elevated temperature. In this way, the temperature of the atmospheric air that passes through the gap 22 across the transition area 14 can be significantly increased. Such air can be warmed to such a degree that its impact on the temperature within the chamber 10 is minimal, thereby eliminating low temperature zones within the chamber 10 in the areas near the lower gaps.

Figure 7:
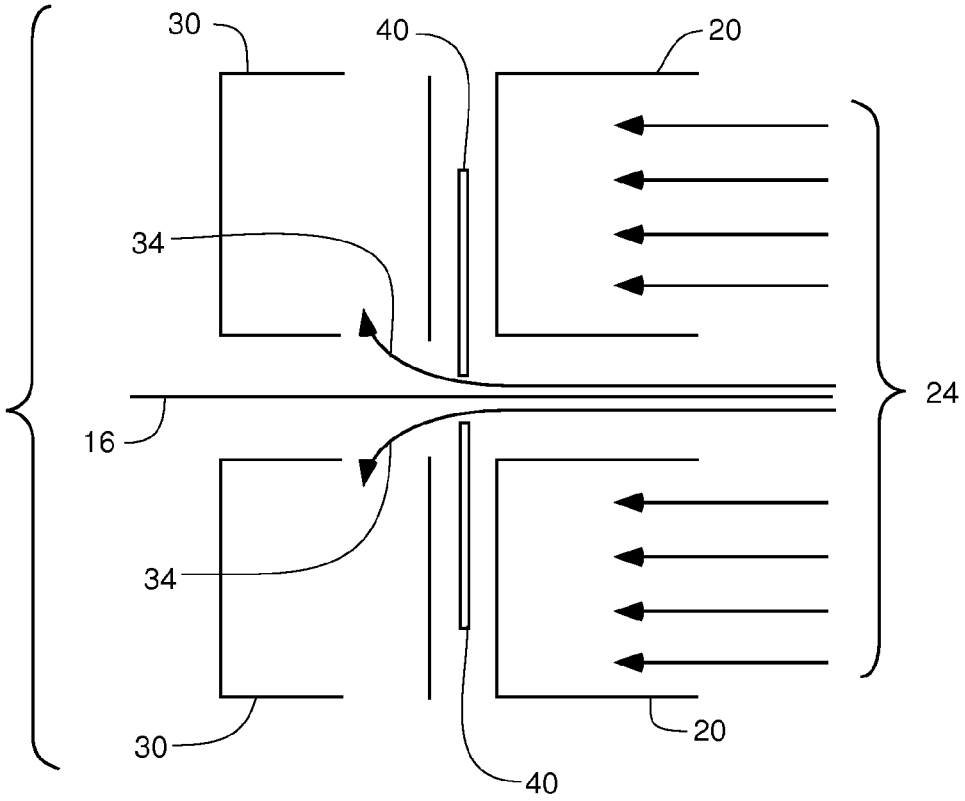
FIG. 7 is a schematic side view of a portion of an oxidation oven in accordance with embodiments of the present invention.

FIG. 7 shows a closer view of capture ducts 30 in operation in a manner similar to that of FIG. 5. One difference between FIG. 7 and FIG. 5 is that FIG. 7 shows two louvers 40 which are configured to reduce the gap through which the precursor fiber 16 passes, thereby reducing even further the likelihood that chamber gas 24 would flow past the return duct 20, past the capture duct 30 and out into the vestibule 12. In preferred embodiments, louvers 40 are positioned near each gap and are interconnected such that movement of a single mechanism moves the louvers 40 into place and out of place, for operation and precursor loading, respectively. In some embodiments, there is both an upper and a lower louver for each gap. In some embodiments, there is either an upper or a lower louver for each gap.

In a similar manner, louvers can be used near the supply ducts in order to reduce the gap through which the precursor fiber passes, thereby reducing even further the likelihood that atmospheric air would flow past the supply ducts, past the return ducts, and into the chamber.

While the capture ducts 30 shown in FIGS. 5 & 7 and the supply ducts 32 shown in FIG. 6 are spaced the same distance from the precursor fiber 16 as are the return ducts 20, such distances need not be the same.

In many embodiments, the distance from the bottom of one return duct to the top of another return duct is approximately three inches. In some embodiments, performance can be enhanced if the distance from the bottom of one capture duct to the top of another capture duct is smaller. For example, such distance can be approximately one inch. The same can hold true for the distance between supply ducts. In particularly preferred embodiments, the distance between capture ducts can be approximately one inch. A lower louver mechanism can reduce the distance of the gap opening even further to ⅜-inch. In some such embodiments, the louver mechanism can operate only with the capture ducts. In some such embodiments a single lever can control operation of all of the louvers.

Referring again to FIG. 4, as alluded to above, the transition area 28 can include a wall (not illustrated) that separates the chamber 10 from the vestibule 12. In some embodiments, the capture ducts 30 and supply ducts 32 can be provided on the chamber side of that wall. In preferred embodiments, the capture ducts 30 and the supply ducts 32 can be provided on the vestibule side of that wall. Such embodiments can provide for improved access to the supply ducts 32 and capture ducts 30. For example, when matter condenses on the surface of the supply ducts 32, the supply ducts 32 can be easily accessed for cleaning by entering the vestibule 12. Additionally, when the capture ducts 30 are positioned on the vestibule side of the wall that separates the vestibule 12 from the chamber 10, many louver mechanisms (such as those discussed in connection with FIG. 7) have more room to operate.

As noted above, FIG. 4 shows 12 supply/capture ducts, with the top six ducts being capture ducts 30 and the bottom six ducts being supply ducts 32. In preferred embodiments, each capture duct 30 and each supply duct 32 is independently regulated. For example, the differential between the capture duct pressure and the chamber pressure in the uppermost capture duct can be significantly greater than that of the lowermost capture duct. In many embodiments, the pressure differential in the lowermost one or more capture ducts may be zero (i.e., such capture ducts are not operating at negative pressure). In many embodiments, only the top one or few capture ducts are operating at negative pressure. Similarly, the positive air pressure from the lowermost supply duct may be significantly greater than that of the uppermost supply duct. For example, the positive air pressure from the uppermost one or more supply ducts may be zero (i.e., such supply ducts are not supplying air). In many embodiments, only the bottom one or few supply ducts are supplying air. Which capture ducts and which supply ducts are operating at which pressures can be selectively determined (e.g., automatically and/or by an operator).

Referring again to FIG. 6, which as indicated above, shows supply ducts 32 in a schematic side view. As can be appreciated, supply ducts 32 can be provided with nozzles, or projections to control the direction of the air flow 38 toward the precursor fiber 16. For example, the flow of air 38 from both above and from below the precursor fiber 16 can be directly towards each other and generally perpendicular to the path of travel of the precursor fiber 16.

Embodiments of the present invention can provide a variety of advantages. For example, some embodiments can result in cleaner vestibules, with a reduced volume of heated chamber air escaping into the vestibule. In some embodiments, there can be significantly less deposit build-up in the vestibule because of the smaller quantity of chamber gas, which is susceptible to condensing in the vestibule because of its relatively lower temperature as compared to the temperature within the chamber. In many embodiments, less energy input is required to maintain the chamber temperature with the supply ducts reducing the quantity of relatively colder air entering the chamber. In some embodiments, the heated length of the precursor fiber path is increased with the lower sections of the chamber being a more uniform temperature all the way between the transition areas. In many embodiments, less energy input is required to the abatement equipment because a smaller quantity of gas is supplied to such equipment (i.e., not all of the gas in the vestibule). Other aspects, features, and advantages will be apparent from the rest of the discussion herein.

In the foregoing detailed description, the invention has been described with reference to specific embodiments. However, it may be appreciated that various modifications and changes can be made without departing from the scope of the invention as set forth in the appended claims. Thus, some of the features of preferred embodiments described herein are not necessarily included in preferred embodiments of the invention which are intended for alternative uses.

The invention claimed is:

1. An oxidation oven comprising:

a heated chamber for heating fibers as the fibers are passed through the chamber, the heated chamber being supplied with heated chamber air, the chamber having two opposing sides, each side having a plurality of return ducts, the return ducts configured to capture at least some of the heated chamber air supplied to the chamber after having passed through the chamber and recirculate back to the chamber the heated air captured using the return ducts, each side further having a plurality of gaps, adjacent return ducts having one gap positioned therebetween, the gaps allowing the fibers to be passed to and from the chamber;

a plurality of capture ducts, each of the plurality of capture ducts positioned near one of the plurality of gaps, the capture ducts configured to capture at least some of the heated chamber air supplied to the chamber that is not captured by the return ducts after having passed through the chamber.

2. The oven of claim 1, wherein the plurality of capture ducts are configured to be functionally connected to a source of negative pressure, the negative pressure thereby allowing the capture ducts to draw in heated chamber air that would otherwise flow through the gaps.

3. The oven of claim 2, wherein the plurality of capture ducts are further configured to draw in substantially all of the heated chamber air that would otherwise flow through the gaps.

4. The oven of claim 2, wherein the capture ducts are further configured so that when the source of negative pressure is connected to the plurality of capture ducts, the negative pressure within each of the plurality of capture ducts can be independently regulated.

5. The oven of claim 1, further comprising abatement equipment, wherein the plurality of capture ducts are configured to be functionally connected to the abatement equipment.

6. The oven of claim 5, wherein the plurality of capture ducts are further configured to be functionally connected to a source of negative pressure, the negative pressure thereby allowing the capture ducts to draw in heated chamber air, that would otherwise flow through the gaps, and deliver that air to the abatement equipment.

7. The oven of claim 1, wherein:

the heated chamber has an upper portion and a lower portion;

the plurality of gaps are comprised of an upper fraction of gaps and a lower fraction of gaps, the upper fraction of gaps being located in substantially the upper portion of the heated chamber; and each of the plurality of capture ducts being positioned near one of the upper fraction of gaps.

8. The oven of claim 1, further comprising a plurality of louvers, each of the plurality of louvers positioned near one of the plurality of gaps, and each of the plurality of louvers are configured to reduce the size of each of the plurality of gaps.

9. The oven of claim 8, wherein the louvers are further configured to move from a first position to a second position, wherein the size of each of the plurality of gaps is greater when the louvers are in the first position than when the louvers are in the second position.

10. The oven of claim 9, wherein the distance between a pair of adjacent louvers is ⅜ of one inch when the louvers are in the second position.

11. An oxidation oven comprising:

a heated chamber for heating fibers as the fibers are passed through the chamber, the chamber having:

two opposing sides, an upper portion, and a lower portion, each side having a plurality of return ducts configured to recirculate heated air back to the chamber, each side further having a plurality of gaps, each of the plurality of gaps positioned between adjacent return ducts, the gaps allowing the fibers to be passed to and from the chamber;

a plurality of supply ducts, each of the plurality of supply ducts positioned near one of the plurality of gaps of the lower portion of the chamber, the supply ducts configured to supply heated air sufficient to form a cushion of air inhibiting air present outside of the heated chamber from entering the chamber through the gaps of the lower portion of the chamber.

12. The oven of claim 11, further comprising a plurality of capture ducts, each of the plurality of capture ducts positioned near one of the plurality of gaps of the upper portion of the chamber.

13. The oven of claim 12, wherein the supply ducts are configured to be functionally connected to a source of pressurized heated air, thereby allowing the supply ducts to supply heated air; and wherein the capture ducts are configured to be functionally connected to a source of negative pressure, the negative pressure thereby allowing the capture ducts to draw in heated chamber air that would otherwise flow through the gaps.

14. The oven of claim 13, wherein the supply ducts are further configured so that when the source of pressurized heated air is connected to the plurality of supply ducts, the pressurized heated air within each of the plurality of supply ducts can be independently regulated; and wherein the capture ducts are further configured so that when the source of negative pressure is connected to the plurality of capture ducts, the negative pressure within each of the plurality of capture ducts can be independently regulated.

15. The oven of claim 11, wherein the supply ducts have openings that are configured to supply air in an orientation that is substantially perpendicular to a direction of travel of the fibers, when the fibers are passed to and from the chamber.

16. A method of processing fibers using an oxidation oven, the method comprising:

(a) passing precursor fibers through a heated chamber of an oxidation oven, the chamber having two opposing sides, each side having a plurality of gaps and a plurality of return ducts, adjacent return ducts having one gap positioned therebetween, wherein the heated chamber is supplied with heated chamber air;

(b) passing the fibers outside of the heated chamber, the fibers passing through the gaps between the inside and outside of the heated chamber;

(c) capturing, using the return ducts, at least some of the heated chamber air supplied to the chamber after having passed through the chamber;

(d) recirculating back to the chamber the heated chamber air captured using the return ducts; and (e) drawing in, using capture ducts positioned near at least some of the gaps, at least some of the heated chamber air supplied to the chamber that is not captured by the return ducts and that would otherwise flow through those gaps after having passed through the chamber.

17. The method of claim 16, wherein the plurality of gaps comprises upper gaps and lower gaps; and wherein drawing in, using capture ducts positioned near at least some of the gaps, at least some of the heated chamber air supplied to the chamber that is not captured by the return ducts and that would otherwise flow through those gaps after having passed through the chamber comprises: drawing in, using capture ducts positioned near the upper gaps, at least some of the heated chamber air supplied to the chamber that is not captured by the return ducts and that would otherwise flow through the upper gaps after having passed through the chamber; and the method further comprising:

(f) supplying heated air near each lower gap, supply ducts being positioned near each of the lower gaps to supply the heated air.

18. The method of claim 17, wherein a negative pressure is supplied to the capture ducts, and a positive pressure is supplied to the supply ducts.

19. The method of claim 17, wherein the supply of heated air to the supply ducts is sufficient to form a cushion of air thereby inhibiting air present outside of the heated chamber from entering the chamber through the lower gaps; and the air drawn-in through the capture ducts is substantially all of the heated chamber air that flows through the gaps.

20. The method of claim 17, wherein the supply of heated air, provided to each supply duct, is independently regulated; and the air drawn-in through each of the capture ducts is independently regulated.

* * * * *